US007325476B2

(12) United States Patent
Sanderson

(10) Patent No.: US 7,325,476 B2
(45) Date of Patent: Feb. 5, 2008

(54) VARIABLE STROKE AND CLEARANCE MECHANISM

(75) Inventor: Robert A. Sanderson, Denton, TX (US)

(73) Assignee: R. Sanderson Management, Inc., Denton, TX (US)

( * ) Notice: Subject to any disclaimer, the term of this patent is extended or adjusted under 35 U.S.C. 154(b) by 0 days.

(21) Appl. No.: 11/137,706

(22) Filed: May 26, 2005

(65) Prior Publication Data

US 2005/0268869 A1 Dec. 8, 2005

Related U.S. Application Data

(60) Provisional application No. 60/574,219, filed on May 26, 2004.

(51) Int. Cl.
*F01B 13/04* (2006.01)

(52) U.S. Cl. ..... 92/12.2; 91/505

(58) Field of Classification Search ..... 92/12.2, 92/13, 13.6, 13.7; 91/505
See application file for complete search history.

(56) References Cited

U.S. PATENT DOCUMENTS

| | | | |
|---|---|---|---|
| 748,559 | A | 12/1903 | Peet |
| 812,636 | A | 3/1906 | Callan |
| 821,546 | A | 5/1906 | Smallbone |
| 1,019,521 | A | 3/1912 | Pratt |
| 1,131,614 | A | 3/1915 | Radtke |
| 1,161,152 | A | 11/1915 | Nyborg |
| 1,161,258 | A | 11/1915 | Shelton |
| 1,194,258 | A | 8/1916 | Walker |
| 1,210,649 | A | 1/1917 | Holley et al. |
| 1,255,973 | A | 2/1918 | Almen |

(Continued)

FOREIGN PATENT DOCUMENTS

| | | |
|---|---|---|
| DE | 89352 | 12/1895 |

(Continued)

OTHER PUBLICATIONS

International Search Report mailed Sep. 26, 2005 for International Application No. PCT/US2005/018425.

(Continued)

*Primary Examiner*—Michael Leslie
(74) *Attorney, Agent, or Firm*—Fish & Richardson P.C.

(57) ABSTRACT

In general, an assembly includes at least one piston housed in a cylinder and a transition arm coupled to the piston. The transition arm is coupled to a member that is housed in a channel defined by a rotating member. Movement of the transition arm adjusts a clearance distance between an end face of the piston and an end wall of the cylinder, and causes the member to slide in the channel such that a stroke of the piston is changed. The member is configured to allow the rotating member to rotate relative to the transition arm and/or configured to allow a change in orientation of the transition arm with respect to the rotating member. In other implementations, the transition arm includes a nose pin and the rotating member is coupled to the nose pin such that axial movement of the transition arm changes an axial position of the piston in the cylinder and causes the nose pin to move relative to the rotating member along an axis other than a central axis of the nose pin.

20 Claims, 7 Drawing Sheets

U.S. PATENT DOCUMENTS

| | | | |
|---|---|---|---|
| RE15,442 E | 9/1922 | Almen | |
| 1,577,010 A | 3/1926 | Whatley | |
| 1,648,000 A | 11/1927 | Lee | |
| 1,659,374 A | 2/1928 | Robson | |
| 1,673,280 A | 6/1928 | Evans | |
| 1,772,977 A | 8/1930 | Arrighi | |
| 1,817,063 A | 8/1931 | James et al. | |
| 1,842,322 A | 1/1932 | Hulsebos | |
| 1,857,656 A | 5/1932 | Oldfield | |
| 1,886,770 A | 11/1932 | Wehr | |
| 1,894,033 A | 1/1933 | Farwell | |
| 1,968,470 A | 7/1934 | Szombathy | |
| 2,042,730 A | 6/1936 | Redrup | |
| 2,048,272 A | 7/1936 | Linthicum | |
| 2,104,391 A | 1/1938 | Redrup | |
| 2,112,934 A | 4/1938 | Stinnes et al. | |
| 2,151,614 A | 3/1939 | Nevatt et al. | |
| 2,247,527 A | 7/1941 | Stinnes | |
| 2,256,079 A | 9/1941 | Dinzl | |
| 2,263,561 A | 11/1941 | Biermann | |
| 2,282,722 A | 5/1942 | Hall | |
| 2,302,995 A | 11/1942 | Holmes | |
| 2,303,838 A | 12/1942 | Hall | |
| 2,335,048 A | 11/1943 | Feroy | |
| 2,341,203 A | 2/1944 | Borer | |
| 2,357,735 A | 9/1944 | Hall | |
| 2,465,510 A | 3/1949 | Bonnafe | |
| 2,513,083 A | 6/1950 | Eckert | |
| 2,532,254 A | 11/1950 | Bouchard | |
| 2,539,880 A | 1/1951 | Wildhaber | |
| 2,653,484 A | 9/1953 | Zecher | |
| 2,737,895 A | 3/1956 | Ferris | |
| 2,827,792 A | 3/1958 | Hopkins | |
| 2,910,973 A | 11/1959 | Witzky | |
| 2,940,325 A | 6/1960 | Nesch | |
| 2,957,421 A | 10/1960 | Mock | |
| 3,000,367 A | 9/1961 | Eagleson | |
| 3,076,345 A | 2/1963 | Leciercq | |
| 3,077,118 A | 2/1963 | Robbins | |
| 3,176,667 A | 4/1965 | Hammer | |
| 3,182,644 A | 5/1965 | Drtina | |
| 3,198,022 A | 8/1965 | Algor de Waern | |
| 3,273,344 A | 9/1966 | Christenson | |
| 3,292,554 A | 12/1966 | Hessler | |
| 3,386,425 A | 6/1968 | Morsell | |
| 3,528,317 A | 9/1970 | Cummins | |
| 3,590,188 A | 6/1971 | Frink et al. | |
| 3,654,906 A | 4/1972 | Airas | |
| 3,842,440 A | 10/1974 | Karlson | |
| 3,847,124 A | 11/1974 | Kramer | |
| 3,861,829 A | 1/1975 | Roberts et al. | |
| 3,877,839 A | 4/1975 | Ifield | |
| 3,906,841 A | 9/1975 | Heyl et al. | |
| 3,939,809 A | 2/1976 | Rohs | |
| 3,945,359 A | 3/1976 | Asaga | |
| 3,956,942 A | 5/1976 | Seki et al. | |
| 3,959,983 A | 6/1976 | Roberts et al. | |
| 3,968,699 A | 7/1976 | van Beukering | |
| 3,969,046 A | 7/1976 | Wynn | |
| 3,974,714 A | 8/1976 | Fritsch | |
| 4,011,842 A | 3/1977 | Davies et al. | |
| 4,060,178 A | 11/1977 | Miller | |
| 4,066,049 A | 1/1978 | Teodorescu et al. | |
| 4,075,933 A | 2/1978 | Stephens | |
| 4,077,269 A | 3/1978 | Hodgkinson | |
| 4,094,202 A | 6/1978 | Kemper | |
| 4,100,815 A | 7/1978 | Kemper | |
| 4,112,826 A | 9/1978 | Cataldo | |
| 4,144,771 A | 3/1979 | Kemper et al. | |
| 4,152,944 A | 5/1979 | Kemper | |
| 4,168,632 A | 9/1979 | Fokker | |
| 4,171,072 A | 10/1979 | Davis, Jr. | |
| 4,174,684 A | 11/1979 | Roseby et al. | |
| 4,178,135 A | 12/1979 | Roberts | |
| 4,178,136 A | 12/1979 | Reid et al. | |
| 4,203,396 A | 5/1980 | Berger | |
| 4,208,926 A | 6/1980 | Hanson | |
| 4,231,724 A | 11/1980 | Hope et al. | |
| 4,235,116 A | 11/1980 | Meijer et al. | |
| 4,236,881 A | 12/1980 | Pfleger | |
| 4,270,495 A | 6/1981 | Freudenstein et al. | |
| 4,285,303 A | 8/1981 | Leach | |
| 4,285,640 A | 8/1981 | Mukai | |
| 4,294,139 A | 10/1981 | Bex et al. | |
| 4,297,085 A | 10/1981 | Brucken | |
| 4,323,333 A | 4/1982 | Apter et al. | |
| 4,342,544 A | 8/1982 | Pere | |
| 4,345,174 A | 8/1982 | Angus | |
| 4,349,130 A | 9/1982 | Bair | |
| 4,418,586 A * | 12/1983 | Maki et al. | 92/12.1 |
| 4,433,596 A | 2/1984 | Scalzo | |
| 4,449,444 A | 5/1984 | Forster | |
| 4,454,426 A | 6/1984 | Benson | |
| 4,473,763 A | 9/1984 | McFarland et al. | |
| 4,478,136 A | 10/1984 | Heiser et al. | |
| 4,489,682 A | 12/1984 | Kenny | |
| 4,491,057 A | 1/1985 | Ziegler | |
| 4,505,187 A | 3/1985 | Burgio di Aragona | |
| 4,513,630 A | 4/1985 | Pere et al. | |
| 4,515,067 A | 5/1985 | Heyl | |
| 4,545,507 A | 10/1985 | Barall | |
| 4,569,314 A | 2/1986 | Milu | |
| 4,602,174 A | 7/1986 | Redlich | |
| 4,602,554 A | 7/1986 | Wagenseil et al. | |
| 4,708,099 A | 11/1987 | Ekker | |
| 4,715,791 A | 12/1987 | Berlin et al. | |
| 4,729,717 A | 3/1988 | Gupta | |
| 4,776,259 A | 10/1988 | Takai | |
| 4,780,060 A | 10/1988 | Terauchi | |
| 4,811,624 A | 3/1989 | Fritsch | |
| 4,852,418 A | 8/1989 | Armstrong | |
| 4,869,212 A | 9/1989 | Sverdlin | |
| 4,920,859 A | 5/1990 | Smart et al. | |
| 4,941,809 A | 7/1990 | Pinkerton | |
| 4,966,042 A | 10/1990 | Brown | |
| 5,002,466 A | 3/1991 | Inagaki et al. | |
| 5,007,385 A | 4/1991 | Kitaguchi | |
| 5,025,757 A | 6/1991 | Larsen | |
| 5,027,756 A | 7/1991 | Shaffer | |
| 5,044,889 A | 9/1991 | Pinkerton | |
| 5,049,799 A | 9/1991 | Tsai et al. | |
| 5,063,829 A | 11/1991 | Takao et al. | |
| 5,076,769 A | 12/1991 | Shao et al. | |
| 5,088,902 A | 2/1992 | Marioni | |
| 5,094,195 A | 3/1992 | Gozalez | |
| 5,102,306 A | 4/1992 | Liu | |
| 5,113,809 A | 5/1992 | Ellenburg | |
| 5,129,797 A | 7/1992 | Kanamaru | |
| 5,136,987 A | 8/1992 | Schechter et al. | |
| 5,154,589 A | 10/1992 | Ruhl et al. | |
| 5,201,261 A | 4/1993 | Kayukawa et al. | |
| 5,261,358 A | 11/1993 | Rorke | |
| 5,280,745 A | 1/1994 | Maruno | |
| 5,329,893 A | 7/1994 | Drangel et al. | |
| 5,336,056 A | 8/1994 | Kimura et al. | |
| 5,351,657 A | 10/1994 | Buck | |
| 5,397,922 A | 3/1995 | Paul et al. | |
| 5,405,252 A | 4/1995 | Nikkamen | |
| 5,437,251 A | 8/1995 | Anglim et al. | |
| 5,535,709 A | 7/1996 | Yashizawa | |
| 5,542,382 A | 8/1996 | Clarke | |
| 5,553,582 A | 9/1996 | Speas | |
| 5,562,069 A | 10/1996 | Gillbrand et al. | |
| 5,572,904 A | 11/1996 | Minculescu | |

| | | | |
|---|---|---|---|
| 5,596,920 | A | 1/1997 | Umemura et al. |
| 5,605,120 | A | 2/1997 | Hedelin |
| 5,630,351 | A | 5/1997 | Clucas |
| 5,634,852 | A | 6/1997 | Kanamaru |
| 5,676,037 | A | 10/1997 | Yoshizawa |
| 5,699,715 | A | 12/1997 | Forster |
| 5,699,716 | A | 12/1997 | Ota et al. |
| 5,704,274 | A | 1/1998 | Forster |
| 5,762,039 | A | 6/1998 | Gonzalez |
| 5,768,974 | A | 6/1998 | Ikeda et al. |
| 5,782,219 | A | 7/1998 | Frey et al. |
| 5,785,503 | A | 7/1998 | Ota et al. |
| 5,818,132 | A | 10/1998 | Konotchick |
| 5,839,347 | A | 11/1998 | Nomura et al. |
| 5,890,462 | A | 4/1999 | Bassett |
| 5,894,782 | A | 4/1999 | Nissen et al. |
| 5,897,298 | A | 4/1999 | Umemura |
| 5,927,560 | A | 7/1999 | Lewis et al. |
| 5,931,645 | A | 8/1999 | Goto et al. |
| 6,012,903 | A | 1/2000 | Boelkins |
| 6,053,091 | A | 4/2000 | Tojo |
| 6,065,433 | A | 5/2000 | Hill |
| 6,074,174 | A | 6/2000 | Lynn et al. |
| 6,155,798 | A | 12/2000 | Deininger et al. |
| 6,397,794 | B1 | 6/2002 | Sanderson et al. |
| 6,422,831 | B1 | 7/2002 | Ito et al. |
| 6,446,587 | B1 | 9/2002 | Sanderson et al. |
| 6,460,450 | B1 | 10/2002 | Sanderson et al. |
| 6,637,312 | B1 | 10/2003 | Clucas et al. |
| 6,647,813 | B2 | 11/2003 | Green |
| 6,829,978 | B2 | 12/2004 | Sanderson et al. |
| 6,854,377 | B2 | 2/2005 | Sanderson et al. |
| 6,915,765 | B1 | 7/2005 | Sanderson et al. |
| 6,925,973 | B1 | 8/2005 | Sanderson et al. |
| 6,957,604 | B1 * | 10/2005 | Tiedemann et al. ..... 91/506 |
| 7,011,469 | B2 | 3/2006 | Sanderson et al. |
| 2002/0059907 | A1 | 5/2002 | Thomas |
| 2002/0106238 | A1 | 8/2002 | Sanderson et al. |
| 2002/0194987 | A1 | 12/2002 | Sanderson et al. |
| 2003/0084785 | A1 | 5/2003 | Sanderson et al. |
| 2003/0138331 | A1 | 7/2003 | Sanderson et al. |
| 2005/0005763 | A1 | 1/2005 | Sanderson |
| 2005/0079006 | A1 | 4/2005 | Sanderson |
| 2005/0118049 | A1 | 6/2005 | Sanderson |
| 2005/0207907 | A1 | 9/2005 | Sanderson |
| 2005/0224025 | A1 | 10/2005 | Sanderson |
| 2006/0008361 | A1 | 1/2006 | Sanderson |
| 2006/0034703 | A1 | 2/2006 | Sanderson |

FOREIGN PATENT DOCUMENTS

| | | | |
|---|---|---|---|
| DE | 345813 | | 7/1917 |
| DE | 515359 | | 12/1930 |
| DE | 698243 | | 10/1940 |
| DE | 1 037 799 | | 12/1958 |
| DE | 1451926 | | 5/1965 |
| DE | 2030978 | | 1/1971 |
| DE | 2346836 | A1 | 3/1975 |
| DE | 2612270 | | 9/1977 |
| DE | 27 51 846 | | 11/1977 |
| DE | 2633618 | A1 | 2/1978 |
| DE | 29 31 377 | | 2/1981 |
| DE | 3420529 | | 12/1985 |
| DE | 37 00 005 | | 7/1988 |
| DE | 4303745 | | 8/1993 |
| DE | 199 39 131 | | 3/2001 |
| DE | 19939131 | A1 | 3/2001 |
| EP | 0052387 | | 10/1981 |
| EP | 0608144 | | 7/1994 |
| EP | 0856663 | A | 8/1998 |
| EP | 1251275 | A | 10/2002 |
| FR | 461343 | | 12/1913 |
| FR | 815794 | | 4/1937 |
| FR | 1 015 857 | | 10/1952 |
| FR | 1416219 | | 9/1965 |
| FR | 1450354 | | 7/1966 |
| FR | 2149754 | | 3/1973 |
| FR | 2271459 | | 11/1973 |
| FR | 2 300 262 | | 2/1975 |
| FR | 2453332 | | 4/1979 |
| FR | 2 566 460 | | 12/1985 |
| FR | 2 649 755 | | 1/1991 |
| GB | 121961 | | 1/1920 |
| GB | 220594 | | 3/1924 |
| GB | 282125 | | 12/1927 |
| GB | 499023 | | 1/1939 |
| GB | 629318 | | 9/1947 |
| GB | 651893 | | 4/1951 |
| GB | 801952 | | 9/1958 |
| GB | 1127291 | | 9/1968 |
| GB | 2 030 254 | | 10/1978 |
| GB | 1595600 | | 8/1981 |
| GB | 2358845 | | 8/2001 |
| JP | 55-37541 | | 9/1978 |
| JP | 60-164677 | | 8/1985 |
| JP | 61-212656 | | 9/1986 |
| JP | 62-113938 | | 4/1987 |
| JP | 4-143469 | | 5/1992 |
| JP | 09151840 | | 6/1997 |
| WO | WO 91/02889 | | 3/1991 |
| WO | WO 92/11449 | | 7/1992 |
| WO | WO 97/10415 | | 3/1997 |
| WO | WO 99/14471 | | 3/1999 |
| WO | WO 00/15955 | | 3/2000 |
| WO | WO 01/11214 | | 2/2001 |
| WO | WO 01/11237 | | 2/2001 |
| WO | 02/063138 | A | 8/2002 |
| WO | WO 02/063193 | | 8/2002 |
| WO | WO 03/040559 | | 5/2003 |
| WO | WO 03/100231 | | 12/2003 |
| WO | WO 04/113724 | | 12/2004 |

OTHER PUBLICATIONS

Written Opinion mailed Sep. 26, 2005 for International Application No. PCT/US2005/018425.

Babcock, George H., "Substitutes For Steam," Transactions of the American Society of Mechanical Engineers, vol. VII, pp. 708-710, XIIth Meeting, Boston, Nov. 1885.

D M Clucas, PhD and J K Raine, PhD, "Development of a Hermetically Sealed Stirling Engine Battery Charger," Proc Instn Mech Engrs, Part C: Journal of Mech Eng Science, vol. 208, pp. 357-366.

D M Clucas, PhD and J K Raine, PhD, "A new wobble drive with particular application in a Stirling engine," Proc Instn Mech Engrs, Part C: Journal of Mech Eng Science, vol. 208, pp. 337-346.

Advanced diaphragm metering pump technology for lower pressure applications, LEWAecodos®.

Olson, John R., "Speed Varying Loads Affect the Stability of Hydrostatic Transmissions", www.nfpa.com, 1970.

Bloomfield, Louis A., "How Things Work: Electric Motors," howthingswork.Virginia.edu, Oct. 25, 2001, http://rabi.phys.virginia.edu/HTW/electric_motors.html.

Den Hartog, J.P. (Jacob Pieter), "Mechanical Vibrations," Dover Publications, Inc., New York, 1956.

ECycle Inc. schematic.

Freudenstein, "Development of an Optimum Variable-Stroke Internal-Combustion Engine Mechanism from the Viewpoint . . . ," Journal of Mechanisms, Transmissions, and Automation in Design, vol. 105, pp. 259-266, 1984.

Freudenstein, "Kinematic Structure of Mechanisms for Fixed and Variable-Stroke Axial-Piston Reciprocating Machines," Journal of Mechanisms, Transmissions, and Automation in Design, Vl. 106, pp. 355-363, 1984.

International Search Report mailed Aug. 19, 2003 in Int. App. No. PCT/US03/09702.

"Metering Pumps," LEWA modular®, American Lewa, The Technology Advantage.

PCT Written Opinion issued in International Application No. PCT/US03/09702.

Red Barn Engineering Presents, "Internal Combustion Motor with Integral Electric Generator For Use In Electric Vehicles," The MOGEN - Motor Generator - Hybrid Vehicles, http://www.mogen.net/index.shtml, copyright 1998.

Redlich, Robert, "A Summary of Twenty Years Expierence with Linear Motors and Alternators," Sunpower, Inc., Athens, Ohio, U.S.A., 1996, http://www.sunpower.com/tech_papers/pub64/linmot.html.

Sunpower, Inc., "High Efficiency, Oil-Free Compressor: Better Machines for A Better World," http://www.sunpower.com/compressors/compressor/index.html.

Supplementary European Search Report from European Application Number 03 719 515.3.

* cited by examiner

VARIABLE STROKE AND CLEARANCE MECHANISM

This application claims priority under 35 USC §119(e) to U.S. Provisional Patent Application Ser. No. 60/574,219, filed on May 26, 2004, the entire contents of which is hereby incorporated by reference.

BACKGROUND

This invention relates to a variable stroke and clearance mechanism.

In a number of devices (e.g., hydraulic pumps or motors, air compressors or motors, alternators, electric engines, and internal combustion engines), the motion of a piston is used to impart rotation to a flywheel, or vice versa.

SUMMARY

In one general aspect, an assembly includes at least one piston housed in a cylinder and a transition arm coupled to the piston. The transition arm is coupled to a member that is housed in a channel defined by a rotating member. Movement of the transition arm adjusts a clearance distance between an end face of the piston and an end wall of the cylinder, and causes the member to slide in the channel such that a stroke of the piston is changed.

In some implementations, the member is configured to allow the rotating member to rotate relative to the transition arm. In other implementations, the member is alternatively or additionally configured to allow a change in orientation of the transition arm with respect to the rotating member.

Particular implementations of this aspect may include one or more of the following features. The transition arm includes a nose pin that couples the transition arm to the member. An actuator is configured to move the transition arm, for example, axially. A thrust bearing is positioned between a shoulder of transition arm and the member. The member includes a bearing, and a slide member houses the bearing. The channel follows a straight path or curved path.

The transition arm adjusts the clearance distance between the end face of the piston and the end wall of the cylinder by changing an axial position of the piston in the cylinder. The transition arm is coupled to the member such that there is an angle between the transition arm and a central axis of the assembly, and sliding of the member in the channel causes a change to the angle between the transition arm and the central axis, which results in the change to the stroke of the piston. A spring return biases the member towards a shorter stroke position in the channel. The movement of the transition arm simultaneously adjusts the clearance distance and causes the member to slide in the channel.

A number of relationships between the clearance distance and stroke may be provided by the movement of the transition arm. For example, in some implementations, the movement of the transition arm adjusts a clearance distance between the end face of the piston and the end wall of the cylinder such that a constant clearance distance is maintained for different strokes. When the assembly is a refrigeration compressor, the movement of the transition arm adjusts the clearance distance such that a substantially zero top clearance distance is maintained for different strokes.

When the assembly is a combustion engine, the movement of the transition arm adjusts the clearance distance such that a substantially constant compression ratio is maintained for different strokes. Alternatively, the slide member and the channel define a stroke-clearance relationship that provides defined compression ratios for corresponding stroke values.

In another aspect, an assembly includes at least one piston housed in the cylinder and a transition arm coupled to the piston. The transition arm includes a nose pin and a rotating member is coupled to the nose pin such that axial movement of the transition arm changes an axial position of the piston in the cylinder and causes the nose pin to move relative to the rotating member along an axis other than a central axis of the nose pin.

Implementations of this aspect may include one or more of the following features. An actuator is configured to axially move the transition arm. The rotating member is coupled to the nose pin such that the axial movement of the transition arm simultaneously changes an axial position of the piston and causes the nose pin to move.

The rotating member defines a channel and a member is disposed in the channel. The rotating member is coupled to the nose pin by the member and the axial movement of the transition arm causes the member to slide in the channel such that the nose pin moves relative to the rotating member along an axis other than a central axis of the nose pin. The member includes a bearing and the channel follows a straight or curved path.

The axial movement of the transition arm changes the axial position of the piston to adjust a clearance distance between an end face of the piston and an end wall of the cylinder. The rotating member is coupled to the nose pin such that the nose pin moving relative to the rotating member along an axis other than a central axis of the nose pin changes a stroke of the piston. For example, the nose pin is coupled to the rotating member such that there is an angle between the transition arm and a central axis of the assembly, and the nose pin moving relative to the rotating member along an axis other than a central axis of the nose pin causes a change to the angle between the transition arm and the central axis, which results in the change to the stroke of the piston.

A number of relationships between the clearance distance and stroke may be provided by the movement of the transition arm. For example, in some implementations, the movement of the transition arm adjusts a clearance distance between the end face of the piston and the end wall of the cylinder such that a constant clearance distance is maintained for different strokes. When the assembly is a refrigeration compressor, the movement of the transition arm adjusts the clearance distance such that a substantially zero top clearance distance is maintained for different strokes.

When the assembly is a combustion engine, the movement of the transition arm adjusts the clearance distance such that a substantially constant compression ratio is maintained for different strokes. Alternatively, the slide member and the channel define a stroke-clearance relationship that provides defined compression ratios for corresponding stroke values.

In another aspect, a method comprises axially moving a transition arm to change an axial position of a piston in a cylinder while simultaneously moving a nose pin of the transition arm relative to a rotating member along an axis other than a central axis of the nose pin.

Implementations of this aspect may include one or more of the following features. For example, moving the nose pin includes sliding a member coupled to the nose pin in a channel defined by the rotating member. The member comprises a bearing such that moving the nose pin includes sliding a bearing coupled to the nose pin in a channel defined by the rotating member. The member is slid in the channel along a straight path or curved path.

Axially moving a transition arm to change an axial position of a piston in a cylinder adjusts a clearance distance between an end face of the piston and an end wall of the cylinder. Moving the nose pin relative to the rotating member along an axis other than a central axis of the nose pin changes a stroke of the piston. Moving the nose pin relative to the rotating member along an axis other than a central axis of the nose pin causes a change to an angle between the transition arm and a central axis, which results in the change to the stroke of the piston.

A number of relationships between the clearance distance and stroke may be provided. For example, axially moving the transition arm to change the axial position of the piston in the cylinder adjusts a clearance distance between an end face of the piston and an end wall of the cylinder such that a substantially zero top clearance distance is maintained for different strokes. Alternatively, or additionally, axially moving the transition arm to change the axial position of the piston in the cylinder adjusts a clearance distance between an end face of the piston and an end wall of the cylinder such that a substantially constant compression ratio is maintained for different strokes, or such that defined compression ratios exist for corresponding stroke values. In some implementations, axially moving the transition arm to change the axial position of the piston in the cylinder adjusts a clearance distance between an end face of the piston and an end wall of the cylinder such that a constant clearance distance is maintained for different strokes.

The details of one or more implementations are set forth in the accompanying drawings and the description below. Other features, objects, and advantages will be apparent from the description and drawings, and from the claims.

DETAILED DESCRIPTION

Figure 1A:
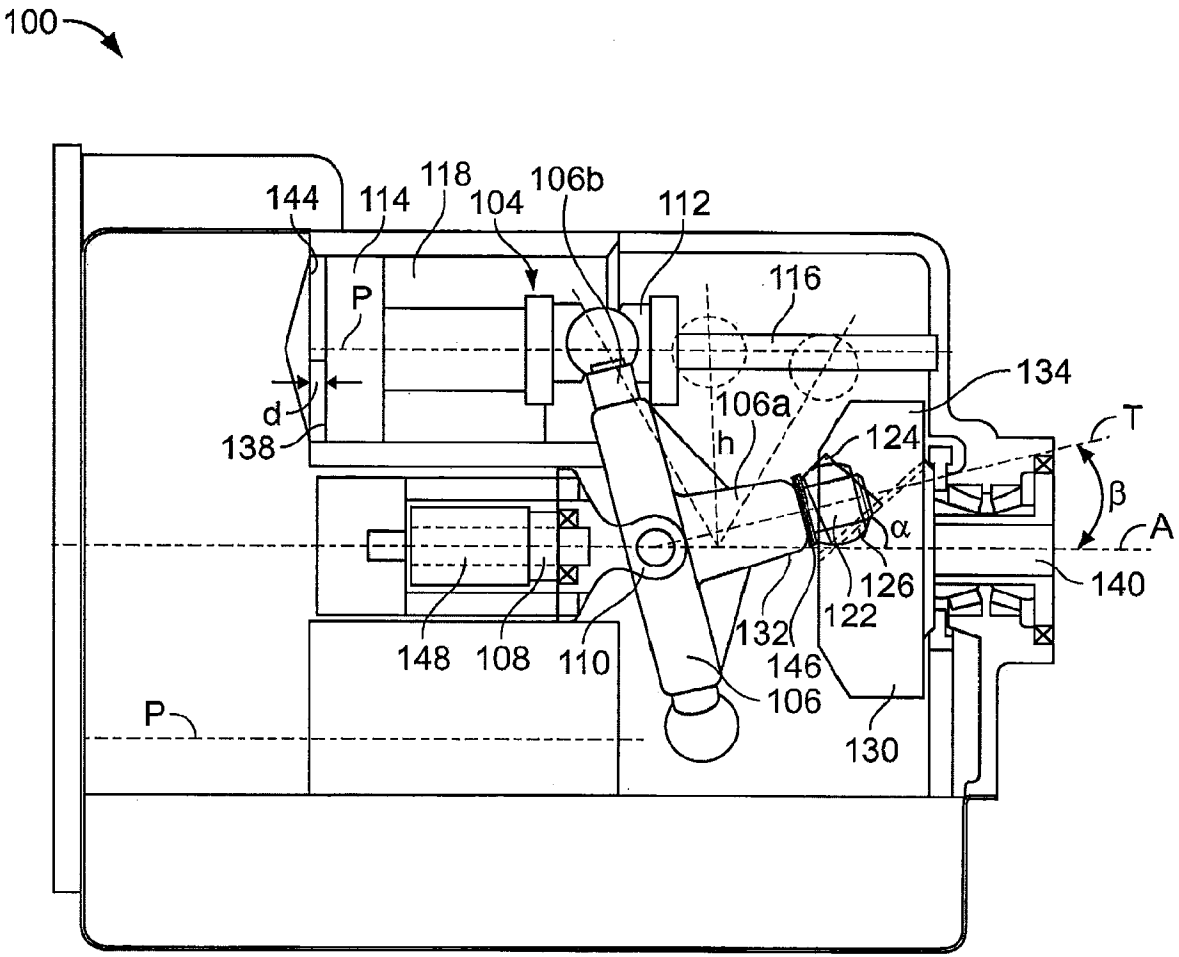
FIGS. 1A and 1B are side views of an assembly that includes a variable stroke and clearance mechanism.
Figure 1B:
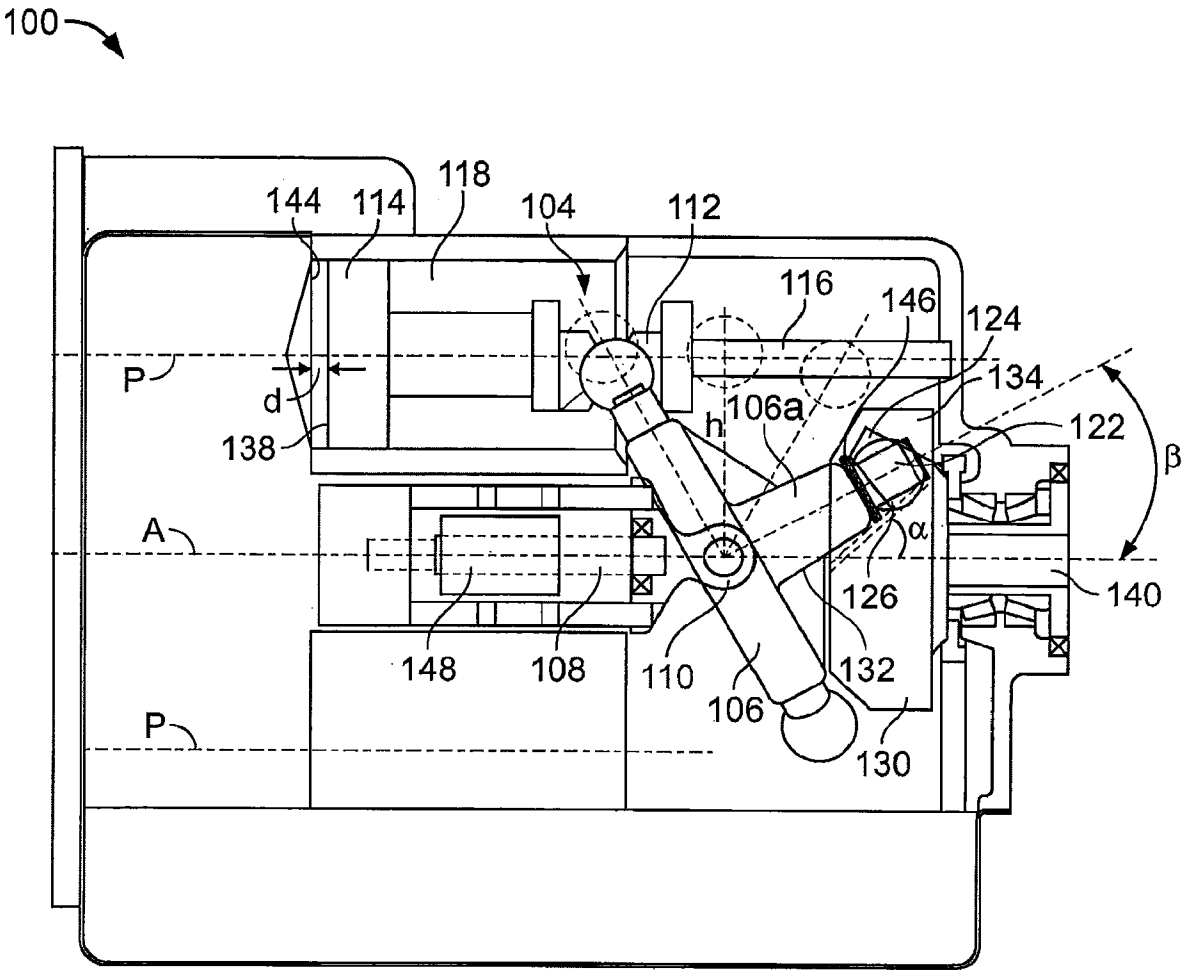
Figure 5:
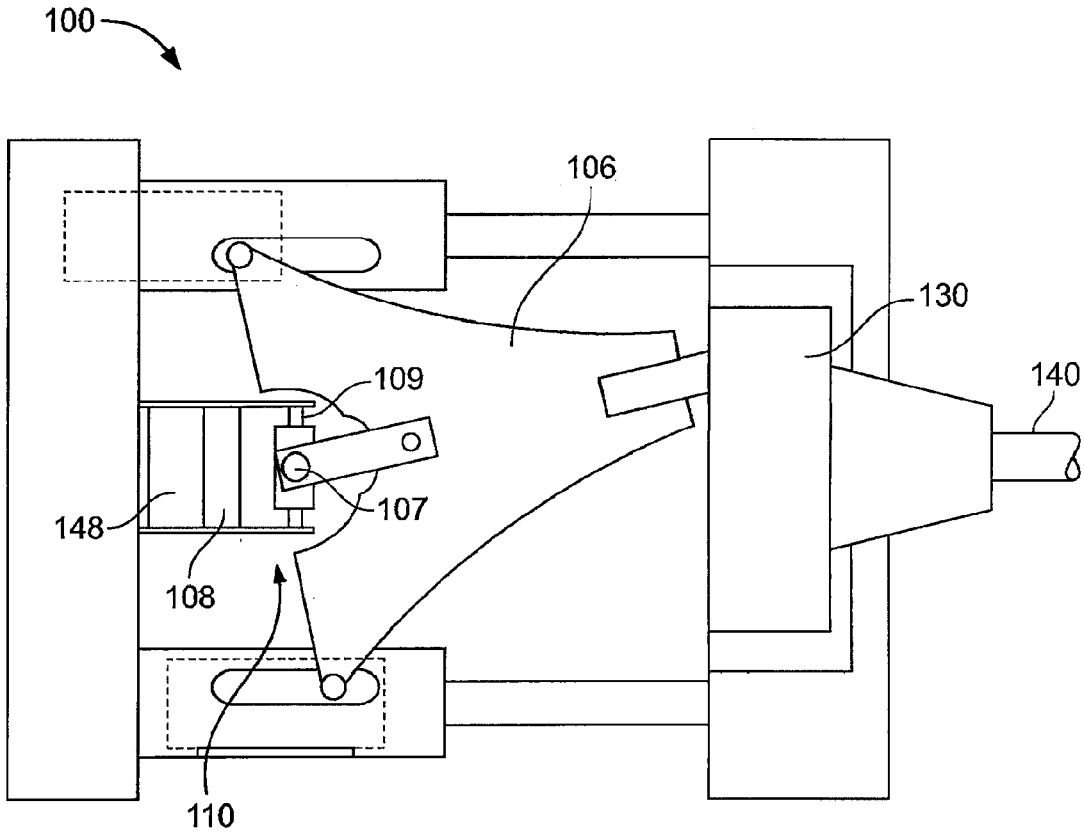
FIG. 5 illustrates an implementation of the assembly having a universal joint.

Referring generally to FIGS. 1A-1B, an assembly 100 includes one or more piston assemblies 104 (e.g., five piston assemblies 104), which are mounted circumferentially around a transition arm 106. Transition arm 106 is supported by, e.g., a universal joint (U-joint) or a constant velocity ball. Referring to FIG. 5, transition arm 106 is connected to a support 108 by a universal joint mechanism 110, including pin 107, which is coupled to transtion arm 106 to allow transition arm 106 to move up and down (as viewed in FIG. 5) and shaft 109 which is coupled to support 108 to allow transition arm 106 to move from side to side. Since transition arm 106 can move up and down while moving side to side, then arm 106*a* can drive flywheel 130 in a circular path. Referring again to FIG. 1, joint 110 can be moved linearly along an assembly axis A, which results in transition arm 106 moving linearly along assembly axis A for reasons discussed below. Joint 110 is connected to support 108, which in turn is connected to an actuator 148. Actuator 148 is configured to move support 108 and joint 110 linearly along assembly axis A. Actuator 148 is, for example, a motor driven screw actuator, such as a ball nut actuator, which acts on support 108 to axially move support 108, joint 110, and transition arm 106.

Transition arm 106 includes drive arms 106*b* coupled to piston assemblies 104 via piston joint assemblies 112 as described in, e.g., FIGS. 23-23A of PCT Application WO 03/100231, filed May 27, 2003 and published Dec. 4, 2003, incorporated herein by reference in its entirety. Piston assemblies 104 include single ended pistons having a piston 114 on one end and a guide rod 116 on the other end. Pistons 114 are received in cylinders 118.

In addition, transition arm 106 also includes an arm 106*a* having a nose pin 122 coupled (as described in more detail below) to a rotating member, e.g., a flywheel 130, such that swing arm 106*a* forms a swing angle f with respect to assembly axis A. Flywheel 130 is coupled to a shaft 140 such that rotation of shaft 140 causes rotation of flywheel 130. Rotation of flywheel 130 results in nose pin 122 moving in a generally circular fashion about assembly axis A. The circular motion of nose pin 122 about assembly axis A is translated by transition arm 106 into a linear motion of piston assemblies 104 along piston axis P. Thus, transition arm 106 translates rotation of flywheel 130 into a linear motion of piston assemblies 104 along piston axis P. Conversely, transition arm 106 translates linear motion of piston assemblies 104 along piston axis P into rotational motion of flywheel 130 and, hence, rotation of crankshaft 140. The translation between rotation of a flywheel and linear movement of pistons by transition arm 106 is further described in, for example, PCT Application WO 03/100231.

Figure 1D:
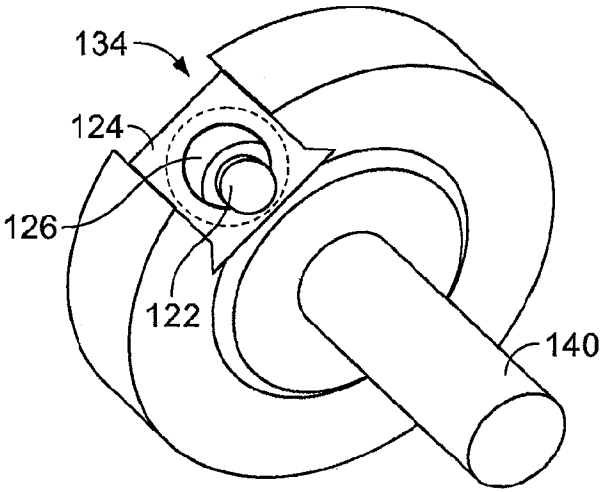
FIGS. 1C and 1D are a side view and perspective view, respectively, of the rotating member with a channel and a slide member.
Figure 1E:
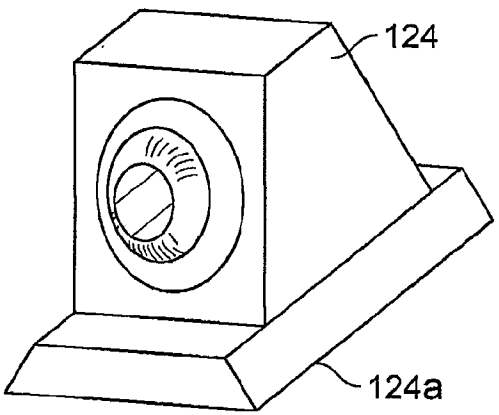
FIG. 1E is a perspective view of the slide member.
Figure 1C:
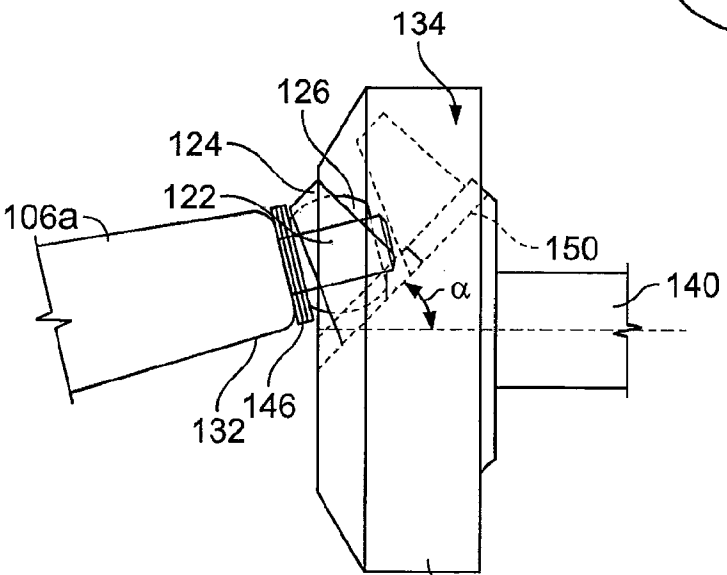

Referring particularly to FIGS. 1C-1E, nose pin 122 is coupled to flywheel 130 by a self-aligning nose pin bearing 126, such as a spherical bearing. Nose pin 122 is axially fixed within a bore of bearing 126, for example, by a washer and snap ring (not shown) placed in a groove located on the portion of nose pin 124 that extends from the bore of bearing 126. Bearing 126 allows transition arm 106 and flywheel 130 to rotate relative to each other. Bearing 126 is contained in slide member 124 and slide member 124 is housed within a channel 134 formed in flywheel 130. Channel 134 has a linear path 150 and forms a selected angle $\alpha$ with assembly axis A. As seen best in FIG. 1E, slide member 124 has a straight base to mate with linear path 150.

A thrust bearing 146 is positioned on nose pin 122 between nose pin bearing 126 and shoulder 132 of transition arm 106. Thrust bearing 146 reduces the friction from the thrust load between transition arm 106, bearing 126, and slide member 124 that results when transition arm is moved axially, as further described below, thereby allowing the slide member 124 and bearing 126 to rotate relative to transition arm 134 as flywheel 130 rotates.

Slide member 124 is represented in FIG. 1C in a first position in channel 134 by solid lines, and in a second position by dashed lines. When slide member 124 is in the first position, the center of bearing 126 is at a radial distance $x_1$ from assembly axis A. As slide member 124 slides to the second position, the radial distance the center of bearing 126 increases to a radial distance $x_2$. Conversely, as slide member 124 slides from the second position to the first position, the radial distance decreases. The change in the radial distance results in a change to the angle β between arm 106*a* and assembly axis A. Bearing 126 rotates as the angle β so as to maintain the alignment of nose pin 124 with the bore of bearing 126.

The value of the angle β determines the stroke of piston assemblies 104. Thus, the change in swing angle β results in a change to the stroke of piston assemblies 104.

Accordingly, referring again to FIGS. 1A and 1B, when joint 110 and transition arm 106 are actuated to axially move along assembly axis A, slide member 124 slides along channel 134, which results in a change of the angle β between swing arm 106*a* and assembly axis A. Consequently, movement of slide member 124 along channel 134 causes a change in the stroke of piston assemblies 104 as described, e.g., with reference to FIGS. 25, 54 and 55 in PCT Application WO 03/100231.

At the same time, movement of transition arm 106 along assembly axis A changes the axial position of piston assemblies 104 within cylinders 118, thereby adjusting the top clearance distance, i.e., the distance d between an end face 138 of piston 114 and an end wall 144 of cylinder 118 pistons 114 are at the top of their stroke. Thus, movement of transition arm 106 along assembly axis A adjusts both the stroke (as a result of slide member 124 and angled channel 134) and the top clearance distance (as a result of the corresponding change in axial position of piston assemblies 104) so that a given stroke value has a corresponding clearance distance value.

Thus, as shown in FIG. 1A, when actuator 148 moves transition arm 106 away from flywheel 130, slide member 124 slides down channel 134 to a first position (e.g., a minimum stroke position) and the axial position of piston assemblies 104 changes. Sliding slide member 124 down channel 134 reduces the angle β and, hence, reduces the stroke of piston 114. At the same time, the axial change in the position of piston assemblies 104 results in an adjustment of the top clearance distance d between the end wall of cylinder 118 and the end face of piston 114 because the piston assemblies 104 are moved towards the end wall of cylinder 118.

Referring to FIG. 1B, when actuator 148 moves transition arm 106 towards flywheel 130, slide member 124 slides up channel 134 to a second position (e.g., a maximum stroke position) and the axial position of piston assemblies 104 changes. Sliding slide member 124 up channel 134 increases the angle β and, hence, increases the stroke of piston 114. At the same time, the change in the axial position of piston assemblies 104 results in an adjustment of the top clearance distance d between the end wall of cylinder 118 and the end face of piston 114 because the piston assemblies 104 are moved away from the end wall of cylinder 118.

Accordingly, actuator 148, slide member 124, and channel 134 form a stroke-clearance mechanism that provides a defined relationship between the stroke of piston assemblies 104 and the top clearance distance d between an end face 138 of piston 114 and an end wall 144 of cylinder 118.

As described in PCT Application WO 03/100231 with respect to FIG. 58,a stroke-clearance mechanism can be obtained by fixing bearing 126 within flywheel 130 and axially moving the transition arm 106 while allowing the nose pin 124 to slide through the nose pin bearing 126. If transition arm 106 is moved axially, the axial position of piston assemblies 104 is changed as described above. At the same time, nose pin 124 slides in or out of the nose pin bearing, which changes the angle between the arm 106*a* and axis A. Thus, the stroke and clearance can be adjusted together.

However, in this case, as transition arm 106 moves axially, nose pin 124 only moves relative to flywheel 130 along a central axis T of nose pin 124. Accordingly, adjusting the stroke by sliding the nose pin within the nose pin bearing provides for a limited amount of stroke-clearance relationships that can be designed.

On the other hand, when slide member 124 and channel 134 are used, nose pin 124 moves relative to flywheel along an axis other than its own central axis T. Specifically, nose pin 124 moves along the axis of channel 136 as transition arm 106 is axially moved. This allows for a greater range of possibilities for the stroke-clearance relationship because a range of possibilities exist for the design of the path 150 followed by slide member 124 in the channel 136.

The design of channel 134 determines the stroke-clearance relationship (i.e., determines the value of the top clearance distance d for a given stroke value). For a channel 134 with a linear path, such as path 150, changing the angle α of the path relative to axis A changes the stroke-clearance relationship. In this case, a larger value of the angle α causes a greater change in stroke per unit of movement of joint 110 along axis A.

In general, the particular stroke-clearance relationship implemented depends on the application of assembly 100, and can be experimentally determined for that application. Assembly 100, for example, can be adapted for use as an internal combustions engine. For an engine, the clearance at the top of the piston stroke and the clearance at the bottom of the piston stroke define the compression ratio of the engine. For an engine, it is advantageous to keep the compression ratio substantially constant as stroke is increased, or to decrease the compression ratio as the stroke is increased. Doing so can limit a condition known as detonation, which is an abnormal combustion of the air/fuel mixture that occurs when the compression ratio is above a certain amount for a given output power of the engine.

To determine the path of channel 134 experimentally, the positions of slide member 124 in flywheel 130 that result in the desired maximum and minimum strokes, and the corresponding top clearances at those strokes is determined. When a linear relationship satisfies the needed relationship between stroke and top clearance for each value of the stroke, then a straight line between the two points defines the channel 134.

The appropriate swing angles for the maximum and minimum stroke can be determined based on the relationship between stroke and the angle β, and the appropriate axial position of the joint 110 can be determined using a computerized drawing, such as a CAD drawing, of assembly 100. The stroke is related to β by the following equation:

$$\tan\beta = \frac{.5s}{h}$$

where s is the stroke and h is the distance between assembly axis A and piston axis P.

Once the swing angle for the maximum desired stroke is determined, then, using the CAD drawing, transition arm 106 is placed at the angle needed for the maximum desired stroke, and then moved axially until the top clearance distance d equals the desired distance for the maximum stroke. Similarly, once the swing angle for the minimum desired stroke is determined, transition arm 106 is placed at the angle needed for the minimum desired stroke, and then moved axially until the top clearance equals the desired clearance for the minimum stroke.

Generally, for a constant compression ratio per stroke, the path 150 of channel 134 is linear. Similarly, for a linear relationship between the stroke and compression ratio, the path 150 of channel 134 is linear. As such, the path 150 is determined from the slope of the line between the two points for maximum and minimum stroke, and their corresponding clearance distances.

Figure 2A:
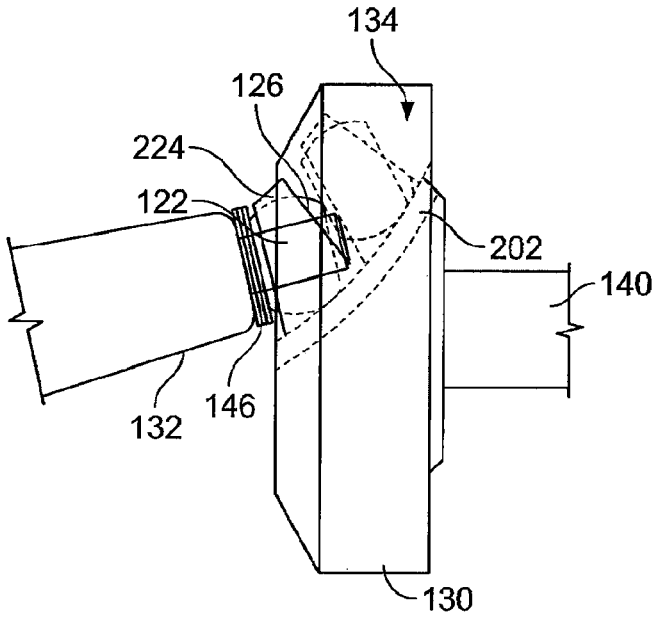
FIG. 2A is a side view showing an alternate implementation of the rotating member with the channel and the slide member.
Figure 2B:
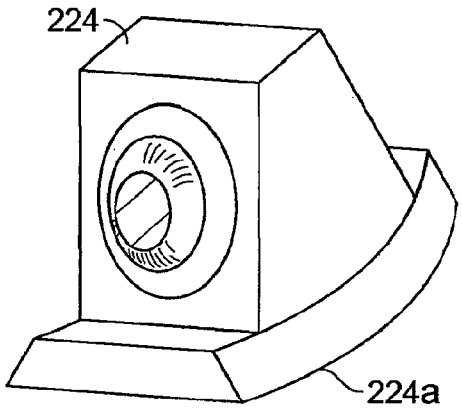
FIG. 2B is a perspective view of an alternate implementation of the slide member.

Referring to FIGS. 2A and 2B, in some implementations, however, the desired relationship between the stroke and top clearance is not linear. In such a situation, the path 202 of channel 134 and base 224*a* of slide member 224 are curved to provide a non-linear relationship. In such a situation, the curve of path 202 is determined by using the CAD drawing to position transition arm 106 for maximum stroke and minimum stroke and determining the end points of the curve. Then, transition arm 106 is positioned based on the desired strokes and clearances between these points to determine intermediary points, and a curve is fitted to these points.

Path 202 in FIG. 2A is a concave path and base 224*a* is convex to mate with path 202. Because path 202 is concave, slide member 124 has to slide a further distance along concave path 202 than linear path 150 to achieve a particular value of β. Hence, to obtain a particular value of stroke using concave path 202, transition arm 106 is axially moved a greater distance towards and away from flywheel 130 than it would be to obtain the same value of stroke using linear path 150. As a result, the compression ratio at the particular value of the stroke is less for concave path 202 than for linear path 150 because the piston assemblies 104 are moved a greater distance away from and towards end wall 144 for concave path 202 than linear path 150, which results in a top clearance distanced d at the stroke value that is greater for concave path 202 than linear path 150.

Figure 2C:
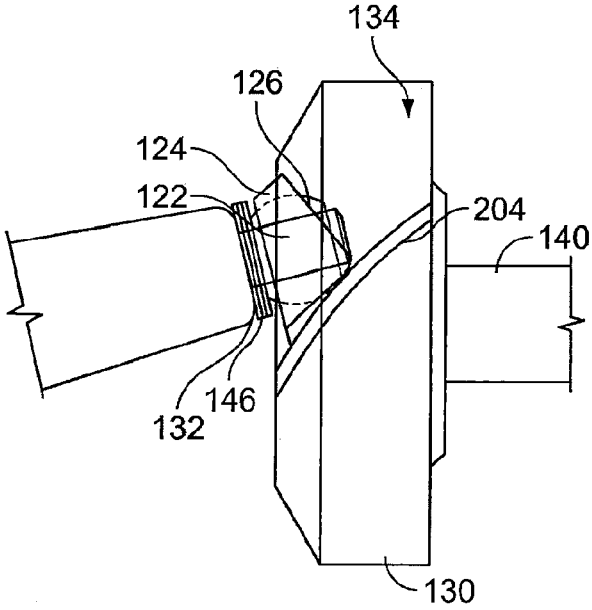
FIG. 2C is a side view of an alternate implementation of the rotating member with the channel and the slide member.

This situation can be reversed, as shown in FIG. 2C, by using a convex path 204 and a slide member 224 with a concave base (not shown). In this situation, the compression ratio at a particular value of the stroke is greater than it would be for the same value of stroke using linear path 150.

Referring again to FIGS. 1A and 1B, as an example of an engine in which the compression ratio remains substantially constant as the stroke changes, joint 110 and transition arm 106 are configured to move axially a distance of approximately 1.4 inches from a first position to a second position. An angle α of path 150 is approximately 44.7°. This results in a minimum swing angle β of approximately 14.5° and maximum swing angle of approximately 30°. The distance h from assembly axis A to piston axis P is approximately 4.28 inches. This results in a minimum stroke of approximately 2.3 inches and a maximum stroke of 4.6 inches. At the minimum stroke, the top clearance distance d is approximately 0.156 inches, while at maximum stroke, the top clearance distance is approximately 0.413 inches. This results in approximately a 10:1 compression ratio for the range of strokes, assuming that the end wall 144 of cylinder 118 is uneven, and a stroke of 0.1 inches covers the change in volume (as compared to a perfect cylinder) created by the unevenness.

If the end wall 144 of cylinder 118 was even, then the top clearance distances that provide a compression ratio are 0.513 inches at maximum stroke and 0.256 inches at minimum stroke. However, the end wall of a cylinder is normally uneven, which changes the volume. This changed volume is taken into account by subtracted 0.1 inches from the top clearance distances that are needed for an even end wall 144.

As an example of an engine in which the compression ratio linearly decreases as stroke increases (and vice versa), joint 110 and transition arm 106 are configured to move axially a distance of approximately 1.41 inches from a first position to a second position. An angle α of path 150 is approximately 47.4°. This results in a minimum swing angle β of approximately 14.50 and a maximum swing angle of approximately 32.10. The distance h from assembly axis A to piston axis P is approximately 4.3 inches. This results in a minimum stroke of approximately 2.3 inches and a maximum stroke of 4.6 inches. At the minimum stroke, the top clearance distance d is approximately 0.065 inches, while at maximum stroke, the top clearance distance is approximately 0.413 inches.

Figure 3:
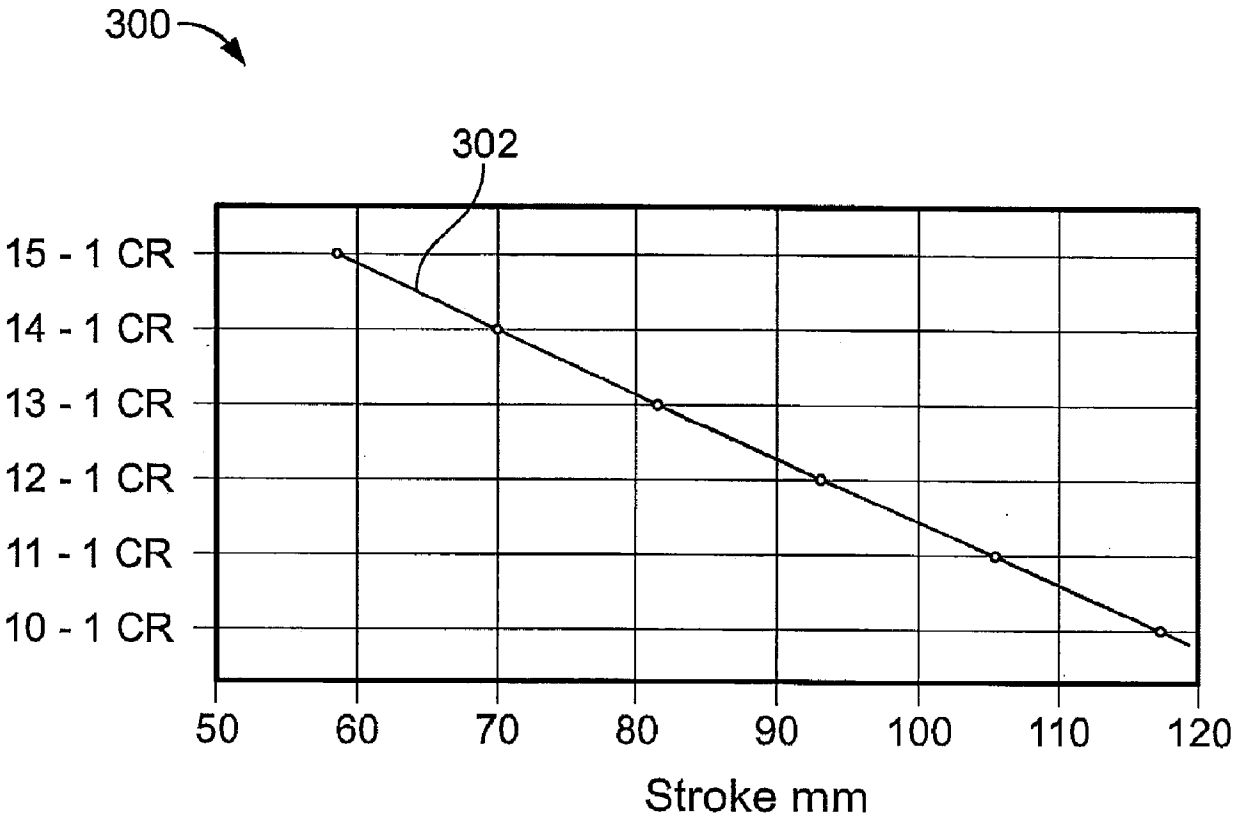
FIG. 3 is a graph showing a linear relationship between compression ratio and stroke.

Referring to FIG. 3, such dimensions provide for a compression ratio that varies linearly as shown in graph 300, assuming that end wall 144 is uneven and that 0.1 inches accounts for the changed volume due to the unevenness. Line 302 shows the linear relationship of stroke to compression ratio. As shown, the compression ratio varies linearly from approximately 15:1 at minimum stroke (approximately 2.3 inches), to approximately 10:1 at maximum stroke (approximately 4.6 inches).

Assembly 100 shown in FIGS. 1A-1D can also be adapted for use as, e.g., a refrigeration compressor, an air pump or motor, or a hydraulic pump or motor. Generally, for these devices, it is desirable to have the top clearance distance d as close to zero as possible without contacting the piston end face 138 with the end wall 144 of the cylinder 118. Thus, when assembly 100 is adapted for use as one of these devices, the path of channel 134 is designed to provide a substantially zero top clearance distance d for the range of desired strokes. For instance, channel 134 and positioning of joint 110 can provide a top clearance distance d in the range of ten thousandths of an inch to twenty thousandths of an inch.

Generally, some amount of top clearance distance d exists to allow for manufacturing tolerances and wear of bearings over time, which changes the displacement of piston assemblies 104. The amount of top clearance distance d provided therefore depends on manufacturing tolerances, and the expected change in the displacement of piston assemblies 104. In addition, due to manufacturing tolerances, some variation of the top clearance distance exists between the minimum stoke position and the maximum stroke position, and the absolute amount of variation depends on the assembly size. However, the variation in top distance clearance d as a percentage of the change in stroke between minimum and maximum stroke positions may be kept below 2%.

As with the constant compression ratio, path 150 is generally linear to provide for a substantially zero top clearance distance. However, non-linear paths may be used, for example, to compensate, at least in part, for variations in the top clearance distance d, or to provide for other relationships between stroke and top clearance distance d.

Figure 4:
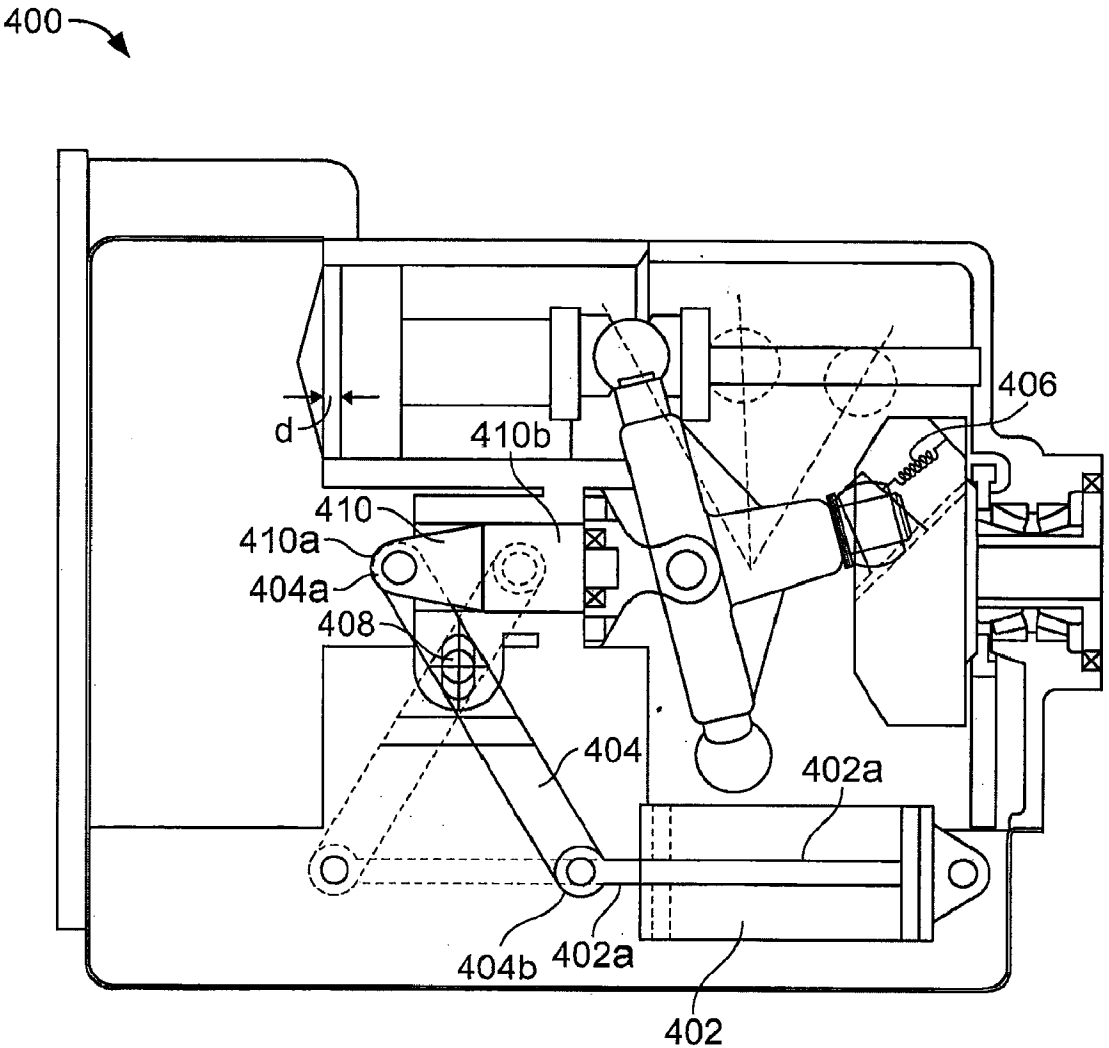
FIG. 4 is a side view of an alternate implementation of the assembly shown in FIG. 1.

Referring to FIG. 4, an assembly 400 is similar to assembly 100 except that an oil pressure cylinder 402, lever 404, and spring return 406 are used to axially move joint 110 and transition arm 106, rather than motor driven screw actuator 148.

In this implementation, joint 110 is attached at one end 410*a* of support 410. Support 410 is keyed or is a spline such that support 410 can move linearly along assembly axis A, but can not rotate about assembly axis A. The other end 410*b* of support 410 is attached to an end 404*a* of lever 404, which is attached to a fulcrum 408. A second end 404*b* of lever 404 is attached to an arm 402*a* of oil pressure cylinder 402. As oil is pumped into cylinder 402, arm 402*a* moves towards lever 404. As arm 402*a* moves toward lever 404, arm 402*a* exerts a force on end 404*b* of lever 404, causing lever 404 to rotate about fulcrum 408*b*. This causes end 404*a* of lever 404 to move towards transition arm 106, thereby exerting a force on support 410 that causes support 410 and transition arm 106 to move axially towards flywheel 130.

As transition arm 106 moves towards flywheel 130, the stroke and clearance are simultaneously changed as a result of slide member 124 sliding in channel 134 (thereby changing swing angle β) and the axial movement of piston assemblies 104, as described above.

When oil is pumped out of cylinder 402, the force exerted by arm 402*a* on lever 404 is decreased, which results in transition arm 106 moving axially away from flywheel 130 and, hence, to a shorter stroke position (i.e., to a smaller swing angle β). Generally, the piston forces provide a pressure on transition arm 106 that urges transition arm 106 and slide member 124 to a shorter stroke position in channel 134 and the force exerted by arm 402*a* on lever 404 is needed to move transition arm 106 such that slide member 124 moves to a longer stroke position (to a greater swing angle β) in channel 134. Thus, simply by reducing the force exerted by arm 402*a*, the piston forces will act to move transition arm 106 and slide member 124 to a shorter stroke position. However, spring return 406 is used to assure that slide member 124 returns to a shorter stroke position when the force exerted by arm 402*a* is decreased.

A number of implementations have been described. Nevertheless, it will be understood that various modifications may be made. For example, while five piston assemblies have been described, fewer or more piston assemblies may be used (e.g., 1, 2, 3, 4, 7, 8, etc.). In addition, piston assemblies 104 have been illustrated as single-ended piston assemblies. However, double-ended piston assemblies also may be used. Accordingly, other embodiments are within the scope of the following claims.

What is claimed is:

1. An assembly comprising:

a cylinder;

at least one piston housed in the cylinder;

a transition arm coupled to the piston;

a universal joint connecting the transition arm to a support by two pins to permit pivoting motion between the transition arm and the support about two axes;

a first member defining a channel;

a second member coupled to the transition arm and disposed in the channel defined by the first member, the second member configured to allow the first member to rotate relative to the transition arm; and wherein:

movement of the transition arm adjusts a clearance distance between an end face of the piston and an end wall of the cylinder; and movement of the transition arm causes the second member to slide in the channel such that a stroke of the piston is changed.

2. The assembly of claim 1 wherein the second member comprises a bearing.

3. The assembly of claim 2 further comprising a slide member that houses the bearing.

4. The assembly of claim 1 wherein movement of the transition arm adjusts the clearance distance between the end face of the piston and the end wall of the cylinder by changing an axial position of the piston in the cylinder.

5. The assembly of claim 1 wherein the transition arm is coupled to the second member such that there is an angle between the transition arm and a central axis of the assembly, and sliding of the second member in the channel causes a change to the angle between the transition arm and the central axis, which results in the change to the stroke of the piston.

6. The assembly of claim 1 wherein the movement of the transition arm simultaneously adjusts the clearance distance between the end face of the piston and the end wall of the cylinder and causes the second member to slide in the channel such that a stroke of the piston is changed.

7. The assembly of claim 1 wherein the channel follows a straight path.

8. The assembly of claim 1 wherein the channel follows a curved path.

9. The assembly of claim 1 further comprising a spring return that biases the second member towards a shorter stroke position in the channel.

10. The assembly of claim 1 wherein the assembly is a refrigeration compressor.

11. The assembly of claim 1 wherein the movement of the transition arm adjusts the clearance distance between the end face of the piston and the end wall of the cylinder such that a substantially zero top clearance distance is maintained for different strokes.

12. The assembly of claim 1 wherein the assembly is a combustion engine.

13. The assembly of claim 1 wherein the movement of the transition arm adjusts the clearance distance between the end face of the piston and the end wall of the cylinder such that a substantially constant compression ratio is maintained for different strokes.

14. The assembly of claim 3 wherein the slide member and the channel define a stroke-clearance relationship that provides defined compression ratios for corresponding stroke values.

15. The assembly of claim 1 wherein the movement of the transition arm adjusts the clearance distance between the end face of the piston and the end wall of the cylinder such that a constant clearance distance is maintained for different strokes.

16. An assembly comprising:

a cylinder;

at least one piston housed in the cylinder;

a transition arm coupled to the piston;

a universal joint connecting the transition arm to a support by two pins to permit pivoting motion between the transition arm and the support about two axes;

a first member defining a channel;

a second member coupled to the transition arm and disposed in the channel defined by the first member, the second member configured to allow a change in orientation of the transition arm with respect to the first member; and wherein:

movement of the transition arm adjusts a clearance distance between an end face of the piston and an end wall of the cylinder; and movement of the transition arm causes the second member to slide in the channel such that a stroke of the piston is changed.

17. An assembly comprising:

a cylinder;

at least one piston housed in the cylinder;

a transition arm coupled to the piston, the transition arm including a nose pin;

a universal joint connecting the transition arm to a support by two pins to permit pivoting motion between the transition arm and the support about two axes; and a member coupled to the nose pin such that axial movement of the transition arm changes an axial position of the piston in the cylinder and causes the nose pin to move relative to the member along an axis other than a central axis of the nose pin.

18. The assembly of claim 17 wherein the axial movement of the transition arm changes the axial position of the piston to adjust a clearance distance between an end face of the piston and an end wall of the cylinder.

19. The assembly of claim 17 wherein the member is coupled to the nose pin such that the nose pin moving relative to the member along an axis other than a central axis of the nose pin changes a stroke of the piston.

20. A method comprising:

axially moving a transition arm to change an axial position of a piston in a cylinder while simultaneously moving a nose pin of the transition arm relative to a member along an axis other than a central axis of the nose pin; and pivoting the transition arm about two axes with respect to a support using a universal joint connecting the transition arm to the support by two pins.

* * * * *